US006427590B1

(12) United States Patent
Rössler et al.

(10) Patent No.: US 6,427,590 B1
(45) **Date of Patent: *Aug. 6, 2002**

(54) DRIVE FOR A PRINTING PRESS WITH A PLURALITY OF PRINTING UNITS

(75) Inventors: Georg Rössler, Angelbachtal; Detlef Strunk, Heidelberg, both of (DE)

(73) Assignee: Heidelberger Druckmaschinen AG, Heidelberg (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/511,703

(22) Filed: Aug. 4, 1995

Related U.S. Application Data

(63) Continuation-in-part of application No. 08/135,258, filed on Oct. 12, 1993, now abandoned.

(30) Foreign Application Priority Data

Oct. 12, 1992 (DE) ..... 42 34 331

(51) Int. Cl.[7] ..... B41F 5/16
(52) U.S. Cl. ..... 101/181; 101/248; 101/219
(58) Field of Search ..... 101/181, 228, 101/183, 136, 137, 138, 139, 140, 142, 143, 219, 216, 248

(56) References Cited

U.S. PATENT DOCUMENTS

| | | | | |
|---|---|---|---|---|
| 3,452,261 A | | 6/1969 | Tagliasacchi | |
| 4,566,385 A | | 1/1986 | Tappert et al. | 101/183 |
| 4,867,060 A | * | 9/1989 | Hefftler et al. | 101/183 |
| 4,980,623 A | | 12/1990 | Anton | |
| 5,036,764 A | | 8/1991 | Rodi | |
| 5,117,753 A | | 6/1992 | Mamberer | 101/181 |

FOREIGN PATENT DOCUMENTS

| | | |
|---|---|---|
| DE | 1 563 591 | 8/1970 |
| DE | 31 48 449 C1 | 6/1983 |
| DE | 38 28 638 C1 | 7/1989 |
| DE | 39 06 646 | 9/1989 |

* cited by examiner

*Primary Examiner*—Eugene Eickholt
(74) *Attorney, Agent, or Firm*—Laurence A. Greenberg; Werner H. Stemer; Ralph E. Locher

(57) ABSTRACT

Drive for a printing press with a plurality of printing units mechanically interconnected through the intermediary of a gear train, the printing units being associated with respective drive motors for supplying power to the gear train in a preset torque ratio, includes a control device, a device for supplying to the control device information regarding printing-specific variables, said control device including a device for determining, from the printing-specific variables, load-torque changes in the printing units, individually, and for energizing the drive motors so that power flow in the gear train is constant when averaged over time.

11 Claims, 5 Drawing Sheets

DRIVE FOR A PRINTING PRESS WITH A PLURALITY OF PRINTING UNITS

CROSS-REFERENCE TO RELATED APPLICATION

This application is a continuation-in-part of Ser. No. 08/135,258, filed Oct. 12, 1993, now abandoned.

BACKGROUND OF THE INVENTION

Field of the Invention

The invention relates to a drive for a printing press with a plurality of printing units and, more particularly, wherein the printing units are mechanically interconnected through the intermediary of a gear train and are associated, respectively, with a drive motor, the drive motors supplying power to the gear train at a preset torque ratio.

In the printing field, demands are continuously being made both in the direction of rationalization and also in the direction of quality improvement. In order to produce high-quality multi-color prints which have been printed on both sides and possibly also varnished in one passage through the printing press, it is necessary, particularly with respect to sheet-fed printing, to dispose a multiplicity of printing units one behind the other. These printing units must be matched to one another to a high degree with regard to the mode of operation thereof.

In order to achieve a reduction in the loading of the gear train, it is customary to employ multiple drives in the case of a printing press with a plurality of printing units, i.e., a plurality of drive motors are provided which supply power to the gear train at various locations thereof.

It is important, in this respect, that there should be a constant power flow in the gear train throughout the entire printing process. Because a constant power flow causes a constant bracing effect in the gearwheel train, in-register maintenance is thereby assured. Should the power flow in the gearwheel train change due to differences in loading, then uncontrollable bracings or stresses occur in the gearwheels, which are considered to be elastic. Low-frequency vibrations are excited and. have an adverse effect upon the quality of the printed products in the form of ghosting or register errors. Such printing errors normally lead to the printing of waste.

In order to counteract a change in direction of the power flow in the gear train of a printing press, the drive motors conventionally supply the power to the gear train at a preset torque ratio. Although such a measure ensures a constant contact of gear flanks or sides in the gear train, it is not capable of suppressing variations in bracings or stresses in the gearwheel train when changes in loading and speed occur. Register errors caused by a change in the power flow as a result of the inconstant, i.e. variable bracings or stresses are conventionally corrected by the pressman or machine operator through the use of register crosses, or automatically through the intermediary of a mechanical register adjustment in the longitudinal direction of the sheets which are being processed.

SUMMARY OF THE INVENTION

It is accordingly an object of the invention to provide a drive for a printing press with a plurality of printing units which is of such construction as to automatically minimize register errors between the individual printing units automatically.

It is accordingly a conceptual part of the invention to provide a synchronizing drive arrangement for a printing press composed of multiple printing units, which has a gearwheel train inter-connecting the printing units, and which in addition has means for introducing a controlled torque bias at several points of the gearwheel train.

With the foregoing and other objects in view, there is provided, in accordance with the invention, a drive for a printing press with a plurality of printing units mechanically interconnected through the intermediary of a gear train, the printing units being associated with respective drive motors for supplying power to the gear train in a preset torque ratio, comprising a control device, means for supplying to the control device information regarding printing-specific variables, the control device having means for determining, from the printing-specific variables, load-torque changes in the printing units, individually, and for energizing the drive motors so that power flow in the gear train is constant when averaged over time.

In accordance with another feature of the invention, the drive includes a memory operatively associated with the control device and having stored therein characteristic curves for determining load-torque changes as a function of the respective printing-specific variables, as the variables apply individually for each printing unit. Such characteristic curves are determined experimentally, for example in test runs of the printing machine.

In accordance with an alternative feature of the invention, the control device comprises a computing device for computing, through the intermediary of the printing-specific variables, or through changes therein, the load-torque changes occurring in a respective printing unit.

In accordance with an added feature of the invention, the control device has means for compensating for the load-torque change occurring in a respective printing unit by applying to the corresponding drive motor a corresponding change in driving torque, which has been stored in memory or computed.

In accordance with an additional feature of the invention, one of the printing-specific variables is the rotational speed of the printing press.

In accordance with yet another feature of the invention, one of the printing-specific variables is the viscosity of the printing ink in the respective printing units, individually related to the respective printing unit.

In accordance with yet a further feature of the invention, one of the printing-specific variables is the ink distribution in the respective printing units, individually related to the respective printing unit.

In accordance with a concomitant feature of the invention, one of the printing-specific variables is the temperature of at least one of the inking and dampening units in the respective printing units, individually related to the respective printing unit.

Amongst those printing-specific variables which affect the load torque, the press speed, i.e., the rotational speed of the printing press, is of primary significance. The further influencing variables are the viscosity of the printing ink, which may vary, for example, from printing unit to printing unit, the ink distribution in the individual printing units, determination of which is possible, for example, through the positions of the ink keys, and the temperature of the inking-unit and/or dampening unit, the temperature of the inking unit having a by no means insignificant influence on the viscosity of the ink and therefore also on the load torque of the corresponding printing unit.

Other features which are considered as characteristic for the invention are set forth in the appended claims.

Although the invention is illustrated and described herein as embodied in a drive for a printing press with a plurality of printing units, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DESCRIPTION OF THE PREFERRED EMBODIMENTS

Figure 1A:
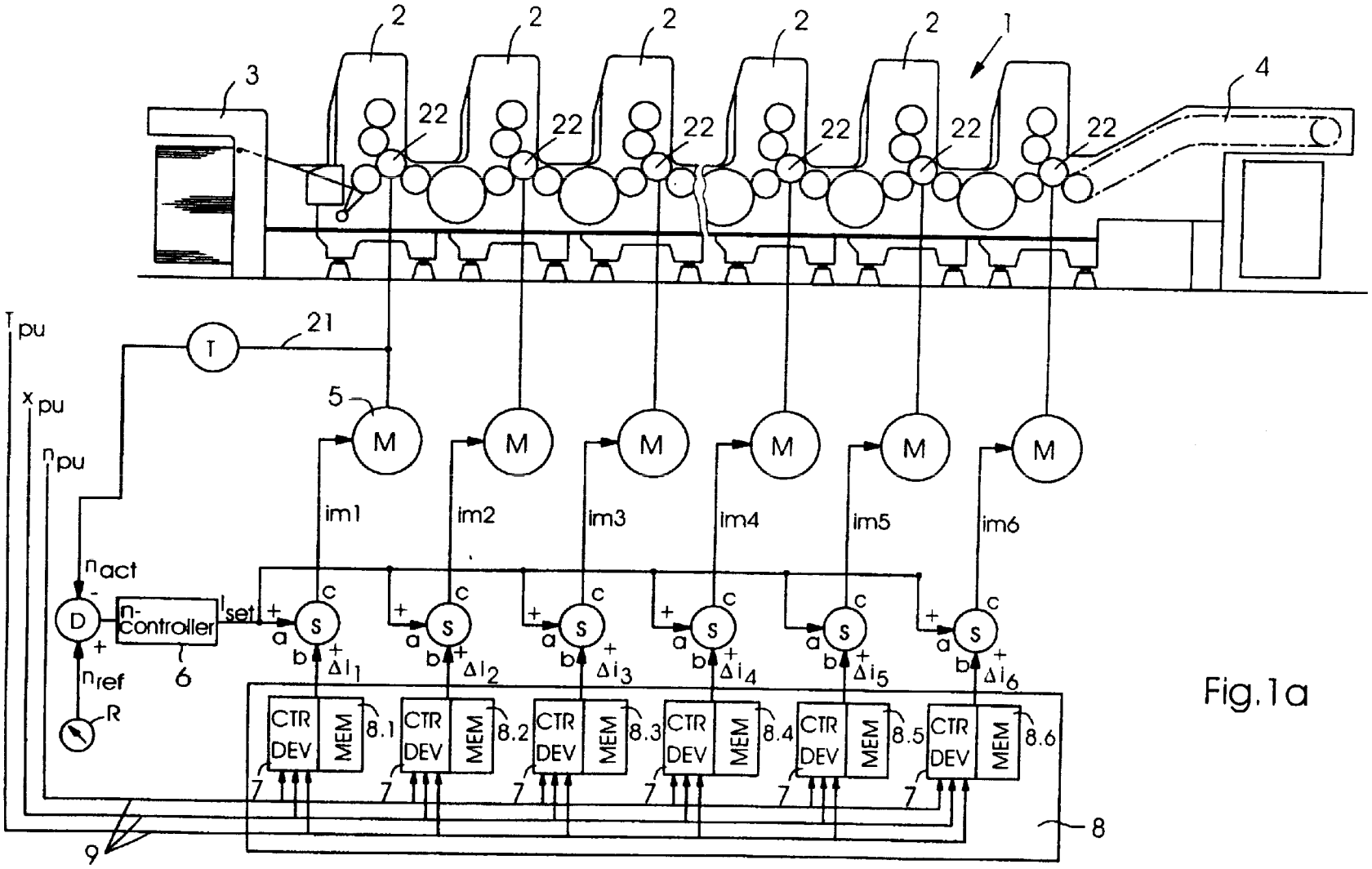
FIG. 1*a* is a diagrammatic and schematic view of a printing press incorporating the drive according to the invention, based on an individual control device and parameter memory for each printing unit.

Referring now to the drawing and, first, particularly to FIG. 1*a* thereof, there is shown therein a diagrammatic and schematic view of a printing press 1 with a drive according to the invention. The printing press 1 has a plurality of printing units 2, a sheet feeder 3 and a sheet delivery 4. Each of the printing units 2 is associated with a respective drive motor 5. The electric drive motors 5 are commonly controlled by a rotational-speed controller 6 which operates to preset the drive current value for all of the drive motors 5 to a common current setpoint value $I_{set}$. In this specific case, the torque-to-current ratio of the drive motors 5 is thus equal for all the drive motors 5.

An electronic unit 8 common for all drive motors 5 comprises for each motor 5, an electric device 7, which is associated with a respective parameter memory unit 8.1 through 8.6. Each parameter memory unit has stored therein in tabular form all variable parameters that may be different from printing unit to printing unit. In particular to be taken in consideration are different degrees of viscosity of the various color inks as a function of the temperature, variation in torque on the drive shaft on each motor 5 as a function of temperature and total ink coverage of the image to be printed, the amount of dampening fluid and other variables. Each control device 7, which will be described in more detail below, generates a respective incremental output current $\Delta i_1$–$\Delta i_6$ for each motor 5 which is delivered to an input b of a respective summing circuit S for each motor 5. Each summing circuit S has another summing input "a" which is connected to the output $I_{set}$ from the n-controller 6. All inputs a of summing circuits S divide the current $I_{set}$ evenly, is that each summing circuit input a receives an input current equal to $I_{set/6}$. Each summing circuit S has an output C which delivers to each drive motor 5 a respective drive current im1–im6 of such a magnitude that each printing unit 2 delivers a positive output torque to the drive train, thereby insuring that all driving tooth flanks of the gear wheels of the drive train maintain positive contact of all times during operation of the printing machine, and at the same time so that the total drive power from all drive motors results in a drive rpm equal to the nominal rpm $n_{ref}$.

As seen in FIG. 1*a*, each printing unit 2 is driven by a respective drive motor 5. All printing units 2 are of substantially identical mechanical construction coupled to a common drive train, and therefore operate at the same rpm, and it follows that they all print on the same printing substrate, e.g. sheets of paper, disregarding for the moment the parameters that are variable for the different printing units, as described above and discussed in more detail below. Each printing unit's drive motor 5 therefore requires a certain basic drive current which is equal to a current I set divided by the number of printing units, in this example six printing units 2.

It should be understood that each summing circuit S may include a linear amplifier in series with output terminal C so that the summing circuit may be able to deliver adequate current $i_m$ to drive the motors M, or such a linear amplifier may be inserted in the connection between the summing circuit S and the motor M.

In order to maintain a required rpm equal to $n_{ref}$ for the printing machine an rpm sensor T is coupled via a link 21 to the machine's drive train, which is composed of mechanically linked rollers 22 and drums of conventional construction. The mechanical linking of the printing units insures that perfect registration is maintained for all ink colors applied to the printed image. The tachometer T generates an output variable which is proportional with the rpm $n_{act}$ of the printing machine. The tachometer output is connected to a negative input of a difference circuit D, which receives the output variable, which is proportional with the actual rpm $n_{act}$ of the printing machine. An adjustable reference current source R delivers a reference output current proportional to the required machine rpm $n_{ref}$. The reference current source R is connected to a positive input of the difference circuit D, which has an output that delivers an output current that is proportional to the difference between $n_{act}$ and $n_{ref}$ to an input of an n-controller 6. The n-controller delivers an output current $I_{set}$ which is set such that all drive motors 5 rotate at an rpm equal to $n_{ref}$, when $n_{act}$ is equal to $n_{ref}$, and none of the printing units is loaded with ink or dampening fluid, or receive incremental current $\Delta i$. The n-controller 6 is of conventional well-known construction. The output $I_{set}$ is connected to one input of six summing circuits S, each having another input b, each connected to a respective output $\Delta i_{m1}$–$\Delta i_{m6}$ of six control devices 7. Each control device is connected to a set of control busses 9 that receive inputs that represent operating variables as described in more detail below.

Changes in given state variables of a printing unit 2, such as changes in rotational speed n, in inking-unit and/or dampening-unit temperature T, in ink distribution X or in viscosity V of the printing ink, lead to load-torque changes $\Delta n_i$ of the individual printing units 2, where i denotes a specific printing unit 2. The drive according to the invention is of such construction that load-torque changes caused by changes in printing-specific variables are automatically compensated. Each drive motor 5 supplies its corresponding printing unit 2 with just enough power to cover the power requirements of the respective printing unit 2, thereby assuring a constant power flow in the gearwheel train.

Because a constant bracing effect in the gearwheel train ensures in-register maintenance of the printed products, a production of in-register printed products is achieved by the drive according to the invention. The required load-torque changes, or the variable power demand of the individual printing units 2, is determined through the intermediary of control devices 7, which are each associated with a respective storage device or memory 8, equipment known, for example, in the art as CP-Tronic System of Heidelberger Druckmaschinen AG.

Via data lines 9, each control device 7 receives information regarding the instantaneous state variables, such as the rotational speed $n_{pu}$ of the printing units 2, the inking-unit and/or dampening-unit temperature $T_{pu}$, the ink distribution $X_{pu}$, the viscosity of the printing ink $V_{pu}$, and so forth.

Each control device 7 is connected with a respective parameter memory 8.1. Stored in the memory 8.1 are tables representing characteristic curves which disclose how the load-torque change $\Delta m_1$ of a respective printing unit 2 changes as a function of or in accordance with the individual printing-specific variables. Because the load-torque changes $\Delta m_i$ are determined so that they compensate for the possible register errors caused between the individual printing units 2 due to the load-torque changes, the automatic application of the calculated load-torque change $\Delta m_i$ ensures that a drive motor 5 will always cover the instantaneously required power demand of the corresponding printing unit 2.

Figure 4:
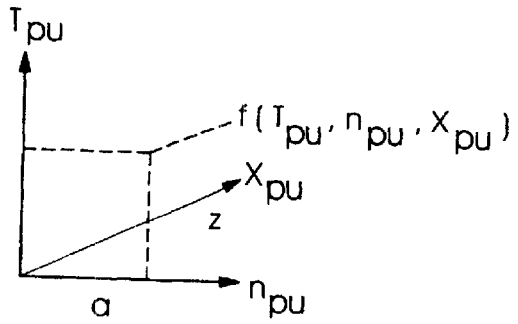
FIG. 4 is a diagram for a table layout for variable parameters in electronic memory.

Storing of variable parameters as functions of other parameters in an electronic data memory is well known. FIG. 4 shows as an example a table structure for handling the aforesaid variable parameters $T_{pu}$, $n_{pu}$, and $X_{pu}$. With three variables, a three-dimensional table space is represented by the variable $n_{pu}$ as abscissa, the variable $T_{pu}$ as ordinate, and the variable $x_{pu}$ as the z-axis. Each point in this three-dimensional space has stored therein a given value f ($T_{pu}$, $n_{pu}$, $X_{pu}$) which represents the additional current increment $\Delta i$ required for each printing unit motor to provide the resultant additional torque required to drive the respective printing unit at the required rpm at the value $n_{ref}$. It follows that the variables $T_{pu}$, $N_{pu}$, and $X_{pu}$ are applied as addresses in the three-dimensional table space shown in FIG. 4.

Figure 2:
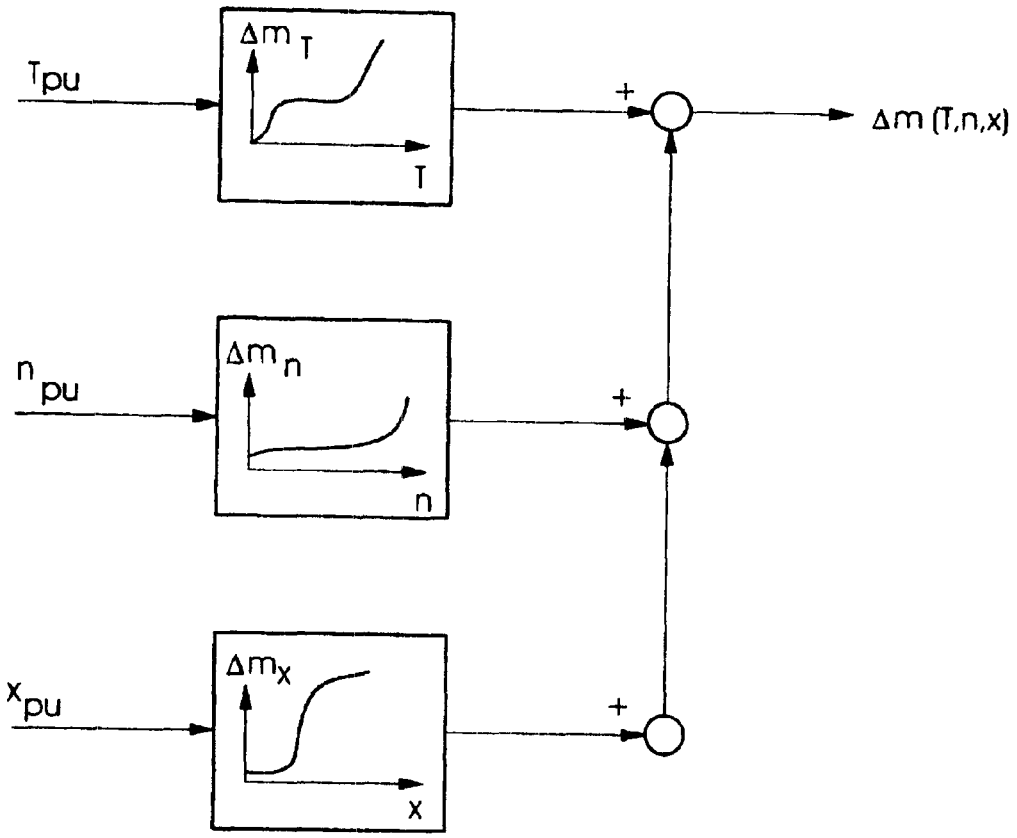
FIG. 2 is a block diagram showing a circuit arrangement with parameter tables for compensating load-torque changes in individual printing units of the printing press.

In the block diagram of FIG. 2, a family of characteristic curves is illustrated which are stored as tables in the storage device or memory 8. The characteristic curves represent the changes in load-torque $\Delta m$ which are a function of the printing-specific values, such as temperature T, rotational speed n or other suitable values x.

Figure 1B:
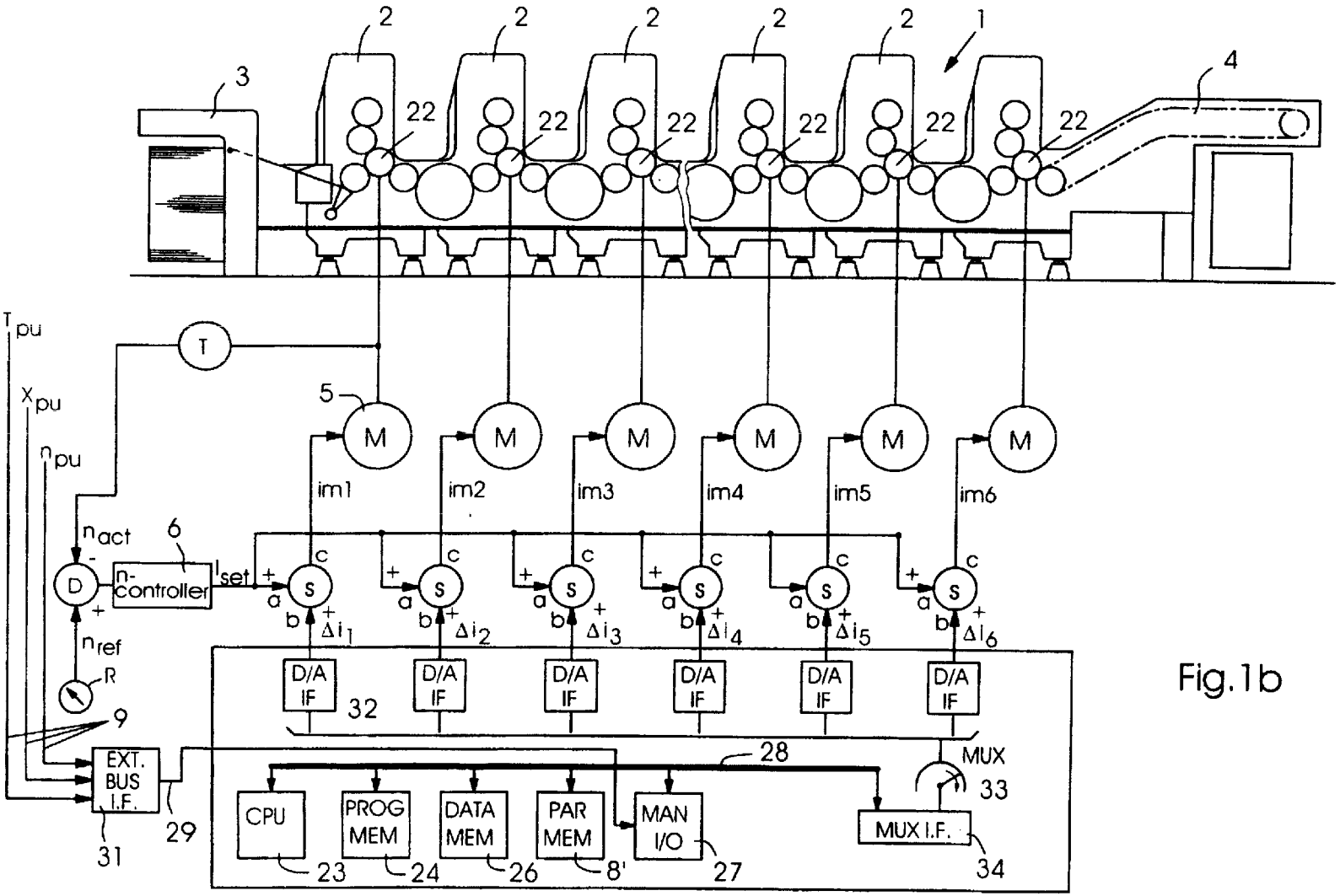
FIG. 1*b* is a diagrammatic and schematic view of a printing press having a drive according to the invention based on a common control arrangement with multiplexed control for the individual motor drives.

FIG. 1*b* shows a modified version of the arrangement according to FIG. 1*a*, wherein a single common variable parameter memory 8' is shared by all six drive motors 5, by means of a common control arrangement composed of a central processing unit CPU 23, a program memory 24, which contains the control program for the system, a data memory 26 which contains fixed data as required for the control program, and a manual input-output interface 27, which are all interconnected by a common data bus 28. An external data bus 29 connects the CPU 23 via the manual interface 27 with external busses 9 via an external bus interface 31. The external busses 9 supply variable parameters, such as $T_{pu}$, $X_{pu}$, and $n_{pu}$, as described above. As in FIG. 1*a* each drive motor 5 is controlled by a respective summing circuit having an input "a" connected to the n-controller 6 and another input b, each connected to a respective digital-to-analog interface D/A IF 32. Each D/A interface 32 has an input connected to a multiplexer MUX 33, which is connected via a multiplexer interface (MUX IF) 34 to the CPU bus 28 and the common parameter memory 8'.

The operation of the multiplexer 33 is conventional in that the CPU successively addresses the parameter memory 8' for data relating to each printing unit 2 and transmits these data via the MUX IF 34, and the respective D/A IF 32 to the respective summing circuit S. In each successive position the multiplexer 33 transmits a digital data word which is translated in the D/A interface 32 to a respective analog current value $\Delta i_1$–$\Delta i_6$.

Figure 5:
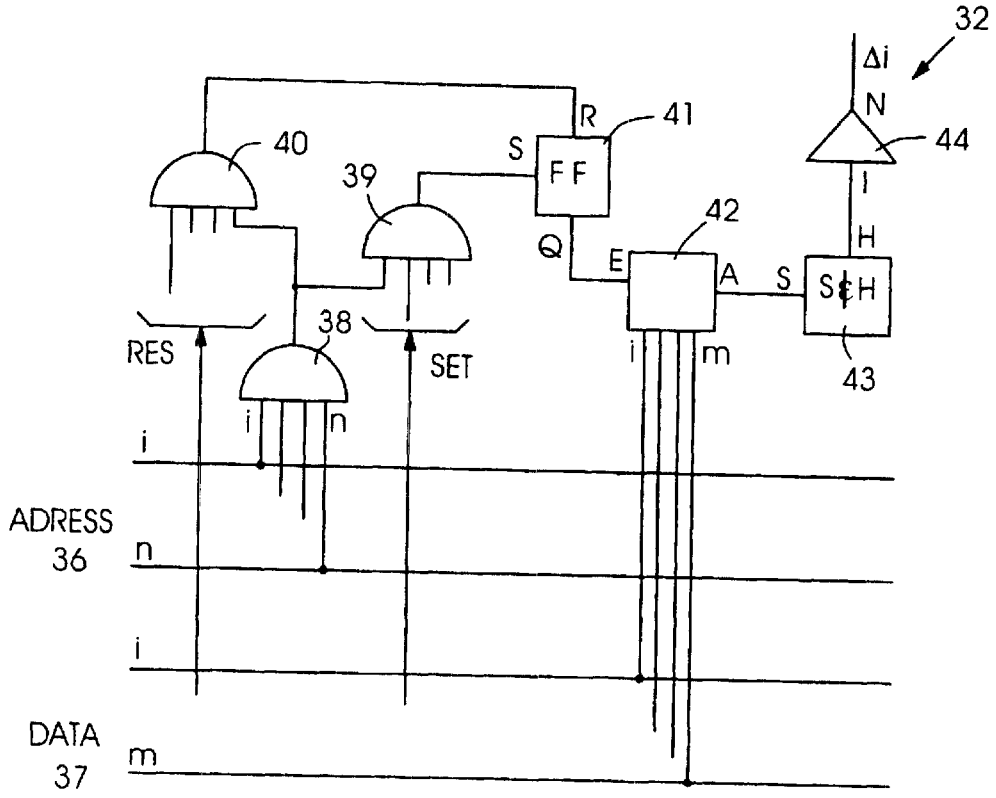
FIG. 5 is a circuit block diagram for a digital-to-analog converter for a control arrangement according to FIG. 1*b*.

FIG. 5 shows details of the multiplexing arrangement, wherein an address bus 36, which is part of the computer bus 28 momentarily addresses, via its address bus 36, one of the six D/A interfaces 32 via an address AND-gate 38, and at the same time issues via the data bus 37 a "set" command to an AND-gate 39, the output of which sets a flip-flop 41 at its set input S. The flip-flop 41 enables from its output Q a digital-to-analog converter 42 at its enable input E. Next the CPU issues via the data bus 37, which is also part of the computer bus 29, a digital data word representing the digital value of the incremental current $\Delta i$, which is applied to the input E of a digital-to-analog converter 42, which generates at its output A an analog current value equal to the incremental current $\Delta i$. This current value is applied to an input S of a sample-and-hold circuit 43, which generates and holds on its output H the entered current value, until a next sample is presented at its input. The output H is connected to the input I of a normalizing amplifier 44, which generates at its output N a normalized value of the incremental current $\Delta i$ for the summing circuit S of the respective drive motor 5. Next, the CPU resets the flip-flop 41 by simultaneously addressing the address gate 38, and activating a reset gate 40, having an output connected to the reset pin R of flip-flop 41. Next the CPU addresses the next following D/A interface 32, and continues sequentially in this manner to maintain the correct incremental current value for all summing circuits S.

A manual input/output circuit (MAN I/O) 27 in FIG. 1*b* serves to manually enter into the parameter memory 8' data relating to which variable parameters that are applicable to the various printing units, such as which inks are used in the respective printing units, and the corresponding viscosities and temperature coefficients and any other information that may be required for determining the incremental current value $\Delta i$ for each printing unit. The variable parameters $T_{pn}$, $X_{pu}$, and $n_{pu}$ as appearing on data busses 9 may also advantageously be entered into the manual I/O unit 27.

Figure 3:
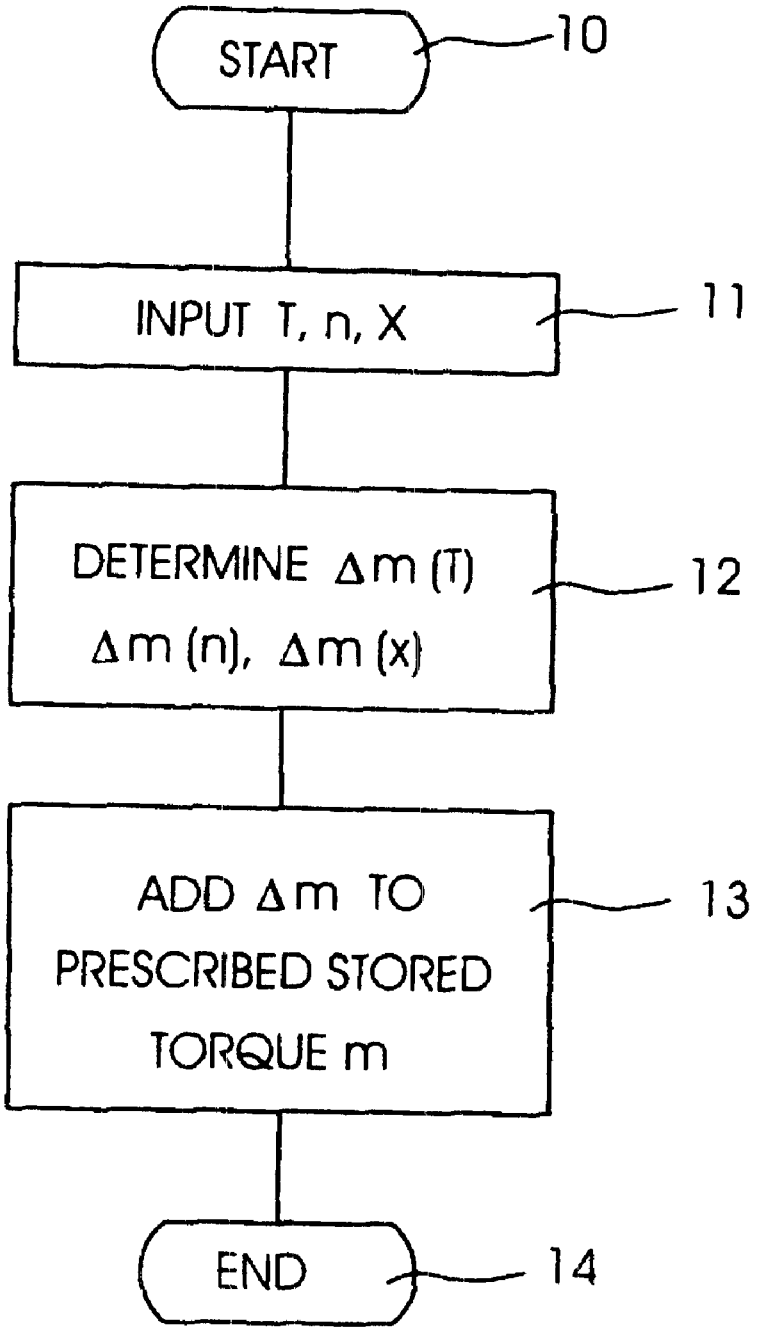
FIG. 3 is a flow chart for a program for determining the change in the load-torque to be compensated.

In the flow chart of FIG. 3, there is shown a program for determining the change in the load-torque to be compensated. After starting at 10, the temperature T, the rotational speed n, and any other suitable value x is inputted into the control device 7 at 11. At 12, the change in load-torque due to temperature variation $\Delta m(T)$, due to rotational speed variation $\Delta m(n)$ and due to variation in any other suitable value $\Delta m(x)$ is determined, respectively, and the determined change in load-torque Am is then added at 13 to the prescribed torque stored in the memory 8, and the program is ended at 14.

What is claimed is:

1. A printing press comprising:

a gear train;

a plurality of printing units mechanically interconnected by said gear train;

a plurality of electric drive motors connected to said gear train for supplying power to said gear train in a preset torque ratio, each one of said plurality of electric drive motors connected to drive a respective one of said plurality of printing units;

an electronic control device; and means for supplying to said electronic control device information regarding printing-specific variables;

said control device having a computing device for individually determining load-torque changes in said plurality of said printing units from said information regarding said printing-specific variables;

said control device including a current generation unit for generating currents in response to said determined load-torque changes and for supplying said currents to the plurality of electric drive motors so that power flow in said gear train is constant when averaged over time; and said gear train deriving power solely from said plurality of said electric drive motors.

2. The printing press according to claim 1, including a memory operatively associated with said control device and having stored therein characteristic curves for disclosing load-torque changes as a function of the respective printing-specific variables, individually.

3. The printing press according to claim 1, wherein said control device comprises a computing device for computing, through the intermediary of said printing-specific variables, the load-torque change occurring in a respective printing unit.

4. The printing press according to claim 1, wherein said control device has means for compensating for the load-torque change occurring in a respective printing unit by applying to the corresponding drive motor a corresponding change in driving torque.

5. The printing press according to claim 1, wherein one of said printing-specific variables is the rotational speed of the printing press.

6. The printing press according to claim 1, wherein one of said printing-specific variables is the viscosity of the printing ink in the respective printing units, individually.

7. The printing press according to claim 1, wherein one of said printing-specific variables is the ink distribution in the respective printing units, individually.

8. The printing press according to claim 1, wherein one of said printing-specific variables is the temperature of at least one of the inking and dampening units in the respective printing units, individually.

9. The printing press for a printing press according to claim 1, wherein said control device is dedicated to a respective printing unit.

10. The printing press for a printing press according to claim 2 wherein said control device is common to all printing units, said control device including a multiplexing arrangement having an input connected with said memory, and a plurality of outputs each connected with a respective printing unit for controlling the power flow of the respective printing unit.

11. The printing press according to claim 1, comprising a memory for storing characteristic curves for use by said computing device in determining said load-torque changes as a function of said information regarding printing specific variables.

* * * * *